US005082046A

United States Patent [19]

Blin

[11] Patent Number: 5,082,046

[45] Date of Patent: Jan. 21, 1992

[54] DEVICE FOR CASTING THIN STRIPS OF METAL BETWEEN

[75] Inventor: Philippe Blin, Plappeville, France

[73] Assignee: Usinor Sacilor, Puteaux, France

[21] Appl. No.: 619,764

[22] Filed: Nov. 29, 1990

[30] Foreign Application Priority Data

Dec. 20, 1989 [FR] France ..... 89 16915

[51] Int. Cl.[5] ..... B22D 11/06

[52] U.S. Cl. ..... 164/428; 29/121.1; 164/429

[58] Field of Search ..... 164/428, 429, 479, 480; 29/121.1

[56] References Cited

U.S. PATENT DOCUMENTS 2,309,585 1/1943 Haddock ..... 29/121.1 X
4,552,199 11/1985 Onoyama et al. ..... 164/429 X
4,830,086 5/1989 Kobayashi et al. ..... 164/428 X

FOREIGN PATENT DOCUMENTS 0229031 7/1987 European Pat. Off. .

OTHER PUBLICATIONS

Patent Abstracts of Japan, vol. 10, No. 134; May 17, 1986.

Patent Document 60-257954 published Dec. 19, 1985.

*Primary Examiner*—J. Reed Batten, Jr.

*Attorney, Agent, or Firm*—Frishauf, Holtz, Goodman & Woodward

[57] ABSTRACT

The surface of each roll (2, 3) has a knurling constituted by two series of parallel grooves (5, 6) which are inclined to the axis (XX) of the roll and joining up at the center of the latter so as to form a series of chevrons, the two grooves (5, 6) of each chevron downwardly converging when they are on the side of the roll (2, 3) in contact with the liquid metal. The device is completed by a cage for extracting the cast product at a speed slightly higher than the speed of rotation of the casting rolls (2, 3). This arrangement avoids the formation of longitudinal or transverse cracks on the surface of the cast thin metal strip.

7 Claims, 1 Drawing Sheet

FIG. 1
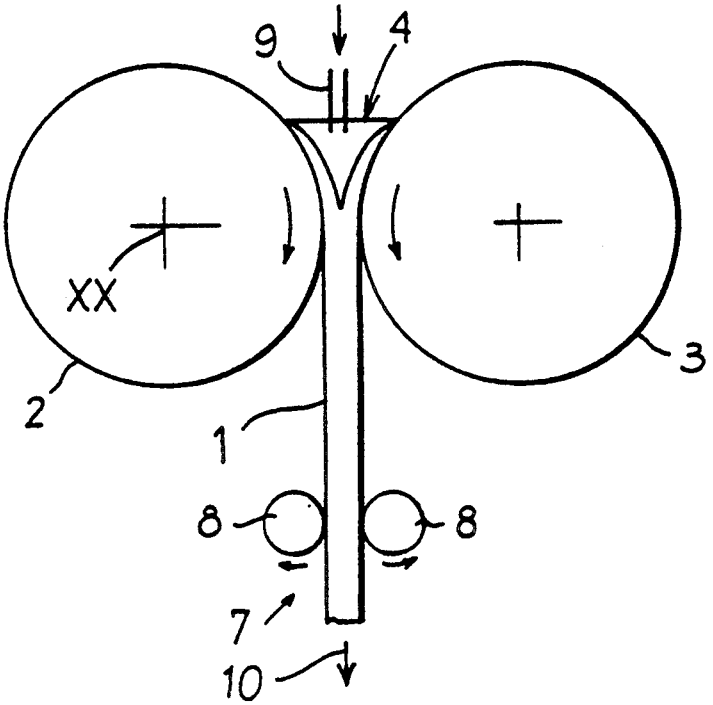
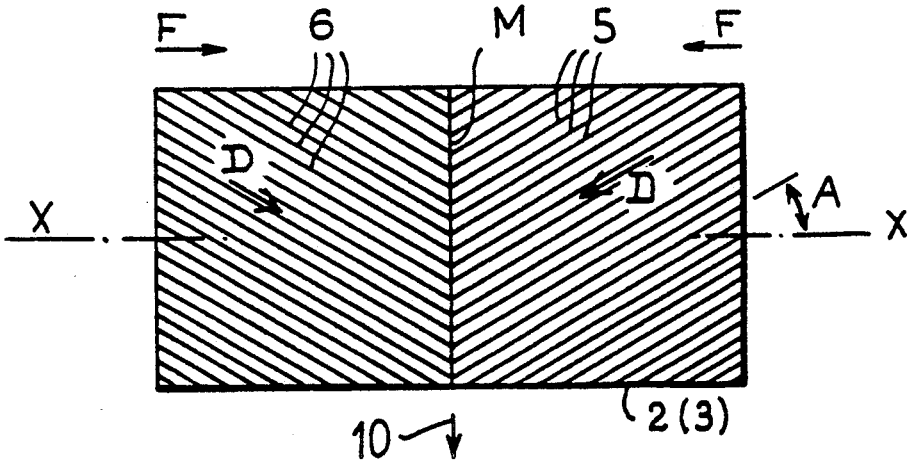
FIG. 2

DEVICE FOR CASTING THIN STRIPS OF METAL BETWEEN

The present invention relates to a device for casting thin strips of metal, in particular steel, on a roll or between two cooled parallel rolls rotating about their respective horizontal axes in opposite directions and disposed at a short distance from each other so as to define a casting space therebetween.

It has been found that strips of great width cast with these devices often have longitudinal surface cracks. The explanation of the formation of these cracks resides in the simultaneous character of the shrinkage of the metal from the start of its surface solidification or freezing and a relative "adherence" of the metal skin to the surface of the rolls which in fact opposes this shrinkage.

In order to solve this problem and cause these cracks, which affect the quality of the surface of the cast product, to disappear, it has in particular been proposed to provide surface irregularities in the form of a check pattern on the rolls. However, it has been found that these check patterns are not fully satisfactory.

An object of the invention is therefore to provide a casting device of the aforementioned type which is so arranged as to solve the considered problem in a satisfactory manner.

According to the invention, the device for casting thin metal strips is characterized in that there are formed on the surface of each roll parallel grooves inclined to the axis of the roll and joining up in a transverse plane of the latter so as to form a series of chevrons on the surface of the roll, the two grooves of each chevron converging downwardly in the direction of extraction of the cast strip when the grooves face toward the casting space.

As the inclination of the grooves is suitably chosen in accordance with the characteristics of the device and as the shrinkage of the metal upon solidification occurs in a direction from the two ends of the roll toward the centre of the latter, it will be understood that this inclination encourages a slipping of the skin of solidified metal toward the axially median plane of the roll, which opposes the formation of cracks.

Advantageously, the device is completed by a cage disposed below the rolls and comprising a pair of strip extracting rolls which rotate at a speed slightly higher than the speed of rotation of the rolls between which the liquid metal is cast.

This slightly higher speed drives the already solidified strip, which results in a slight slipping of the strip in the direction of the grooves during the solidification on the rolls. This slipping therefore advantageously accompanies the transverse shrinkage of the product.

It will be understood that the angle of inclination of the grooves to the horizontal and the amount by which the speed of the extracting rolls of the cage exceeds the speed of the casting rolls, are suitably determined with the aid of a crack detecting system: the persistence of the longitudinal cracks signifies that the higher speed is insufficient, while the formation of transverse cracks signifies that the higher speed is excessive and the tension of the strip is therefore excessive.

The invention will now be described with reference to the accompanying drawing which illustrates an embodiment thereof by way of a non-limitative example.

IN THE DRAWING

FIG. 1 is a diagrammatic end elevational view of a device for casting thin strips of metal between two rolls equipped with an extracting cage in accordance with a preferred embodiment of the invention.

FIG. 2 is a longitudinal elevational view of one of the rolls of the device of FIG. 1 with grooves formed on its surface in accordance with the invention.

The device shown in the drawings is adapted to cast a thin strip 1 of steel between two parallel, horizontal and energetically cooled rolls 2 and 3 rotating in opposite directions. These rolls are spaced a slight distance apart from each other so as to define therebetween a casting space 4 for receiving a bath of liquid metal from above and allowing the metal to leave the device from below after solidification of the metal in contact with the cold walls of the rolls under the effect of the rotation of the latter.

The rolls 2, 3 are rotated about their respective axes XX and cooled internally by well-known means (not shown). The casting space therebetween is supplied with liquid metal, for example by a nozzle 9 mounted on the bottom of a distributor (not shown) placed thereabove.

Formed on the surface of each roll 2, 3 is a knurling constituted by two series of parallel grooves 5 and 6 which are inclined to the axis XX of the roll and join up at the centre of the latter in its median transverse plane M so as to form a series of chevrons on the whole of the surface of the roll.

A first series of parallel grooves 5 is in this way provided on one half of each roll 2, 3 starting at one of the end faces of the latter, and a second series of parallel grooves 6 is provided on the other half of the roll starting at the other end face. The grooves 5 and 6 have the same inclination A with respect to the axis XX, each pair of grooves 5 and 6 constituting a chevron the two grooves of which converge downwardly in the direction of extraction of the product 1 shown by the arrow 10 when they face toward the casting space 4.

The depth of the grooves and their inclination A are suitably chosen in accordance with other parameters of the device. For example, the angle A may be of the order of 45° and the depth of the grooves may be around one hundred microns or even more.

The device is completed by a cage 7 placed below the casting rolls 2, 3 and comprising a pair of rolls 8 for extracting the strip 1 which is consequently pinched between these two rolls 8. The latter are rotated by means known per se (not shown) and rotate at a speed which is slightly higher than the speed of rotation of the casting rolls 2 and 3. This higher speed of the extracting rolls 8—which is a few percent higher than the speed of the casting rolls—and the angle of inclination A of the grooves 5, 6 relative to the horizontal may be determined with the aid of a crack detector, as mentioned before.

When the liquid metal 4 starts to solidify or freeze on contact with the cooled surface of the rolls 2, 3 and thus form a skin, it at the same time undergoes a shrinkage starting at the ends of the roll, symbolically represented by the arrows F. The downward inclination A of the grooves 5, 6 therefore encourages this shrinkage of the skin and the downward slipping of the latter in the direction of the extraction of the product resulting from the slightly higher speed of rotation of the extracting rolls 8 relative to the speed the rolls 2, 3. If the amount by which the speed of the rolls 8 exceeds the speed of the casting rolls 2,3 and the angle of inclination A of the knurling are suitably chosen, there is observed a practically complete disappearance of the longitudinal and transverse cracks on the surface of the cast product 1.

As already mentioned, the speed of rotation of the rolls 8 is increased if the presence of longitudinal cracks is observed, and, on the contrary, decreased if transverse cracks are observed.

The invention is also applicable to the case where the casting device has only a single roll, the liquid metal being cast on the roll from a vessel placed at the side of the latter.

Further, the invention is further applicable in the case where the rolls are grooved on only a portion of their width, for example in the central portion.

What is claimed is:

1. A device for casting a thin metal strip comprising:

at least one roll rotatable about an axis, said at least one roll having a surface;

means for supplying molten metal to said surface of said at least one roll when a thin metal strip is to be cast;

said at least one roll further including:

a plurality of nested, spaced apart, V-shaped chevron-like grooves in said surface of said at least one roll;

each V-shaped chevron-like groove having first and second arm portions defining an angle therebetween; and each of said first and second arm portions of each of said substantially V-shaped chevron-like grooves extending away from said angle formed therebetween in a first direction which is opposite to a second direction in which said thin metal strip is to be cast.

2. The device according to claim 1, wherein the angle defined by said first and second arm portions of each V-shaped chevron-like groove is a given angle, said given angle being the same for all of said plurality of V-shaped chevron-like grooves in said surface.

3. The device according to claim 2, wherein corresponding first arm portions of said plurality of V-shaped chevron-like grooves are parallel to each other, and corresponding second arm portions of said plurality of V-shaped chevron-like grooves are parallel to each other.

4. The device according to claim 1 in which said at least one roll is rotatable about a horizontal axis at a preselected speed, the device further comprising:

a cage disposed below said at least one roll in said second direction, said cage including:

a pair of strip extracting rolls for receiving said metal strip cast by said at least one roll, said strip extracting rolls being rotatable at a predetermined speed slightly higher than said preselected speed.

5. The device according to claim 1, wherein each of said V-shaped chevron-like grooves has a depth, the device further comprising:

crack eliminating means for substantially eliminating cracks in said thin metal strip as said thin metal strip is being cast, said crack eliminating means including means for adjusting at least one of the angular size of said angle defined by said arm portions of said V-shaped chevron-like grooves, said depth of said grooves, said preselected speed of rotation of said at least one roll, and said predetermined speed of rotation of said strip extracting rolls.

6. Device for casting a thin metal strip, comprising:

two cooled substantially parallel rolls rotatable about respective horizontal axes in opposite directions and defining a casting space between said rolls;

each roll having a surface on which are provided two series of substantially parallel grooves, said series of grooves each being inclined to the axis of each roll in respective opposite directions, the grooves of one series of grooves meeting respective grooves of the other series of grooves in a transverse plane of each roll so as to form a plurality of chevrons on said surface;

said grooves of said rolls facing each other across said casting space; and the two series of grooves forming said plurality of chevrons downwardly converging in a given direction in which said strip is to be cast when said grooves of said rolls face each other across said casting space.

7. Device according to claim 6, wherein said two substantially parallel rolls are rotatable at a preselected rotational speed, the device further comprising:

a cage disposed below said rolls, said cage including a pair of strip extracting rolls which are rotatable at a speed slightly higher than said preselected speed of rotation of said rolls defining said casting space.

* * * * *